United States Patent [19]

Tahara

[11] Patent Number: 4,666,043

[45] Date of Patent: May 19, 1987

[54] COSMETIC HOLDER CASING

[75] Inventor: Tomio Tahara, Ageo, Japan

[73] Assignee: Pola Chemical Industries Inc., Japan

[21] Appl. No.: 850,553

[22] Filed: Apr. 11, 1986

[51] Int. Cl.[4] ..... A45C 11/00; A45C 11/34; B65D 83/02; B65D 85/28

[52] U.S. Cl. ..... 206/581; 206/37; 206/38; 206/235; 132/79 A; 132/79 C; 132/DIG. 3

[58] Field of Search ..... 206/37, 38, 214, 235, 206/249, 252, 253, 255, 371, 581; 132/79 A, 79 C, 79 F, 82 A, 82 D, DIG. 3; 221/321

[56] References Cited

U.S. PATENT DOCUMENTS

| | | | |
|---|---|---|---|
| 1,086,065 | 2/1914 | McAdam | 206/252 |
| 2,491,617 | 12/1949 | Lebach | 206/252 |
| 2,619,096 | 11/1952 | Kuhnl | 132/79 C |
| 3,991,775 | 11/1976 | Spatz | 132/79 C |
| 4,562,923 | 1/1986 | Katada et al. | 132/79 C |
| 4,602,649 | 7/1986 | Weckerle | 132/79 C |

*Primary Examiner*—Joseph Man-Fu Moy
*Assistant Examiner*—David T. Fidei
*Attorney, Agent, or Firm*—Wegner & Bretschneider

[57] ABSTRACT

A cosmetic holder casing for a plurality of stick-like cosmetics such as eye shadow, lipsticks and the like is disclosed, and comprises in combination:

a box-like body, a moving holder, a moving cylinder body, a rotating cylinder body, a resilient body, a locking mechanism, and a ratchet mechanism.

The locking mechanism comprising pawl portions provided on the said moving cylinder body and a toothed portion formed on the inner face of said rotating cylinder body, which has a continuous groove for engagement with said pawl portions, said toothed portion having adjacent grooves being varied in depth.

4 Claims, 6 Drawing Figures

COSMETIC HOLDER CASING

BACKGROUND OF THE INVENTION

1. Field of the Invention

The present invention relates to a holder casing for removably holding a plurality of stick-like cosmetic products or a plurality of containers each containing a liquid cosmetic product.

2. Description of the Prior Art

In most cases, stick-like cosmetics such as, for instance, lipsticks and eye shadows are generally of the cylindrical structure, and bear resemblance in size to each other. Thus, when huddled together in a handbag, etc. during carrying, they are mixed up promiscuously with other small necessaries, thus making it to find out the end cosmetic and incurring in convenience in carrying handsful of such cosmetics.

For that reason, it has been proposed to use a cosmetic holder casing including a flat casing in which a plurality of stick-like cosmetics are put order in parallel relation. However, that holder casing is of the type wherein a lid member is opened to pick up the desired cosmetic with difficulty, when use. In addition, there is a fear that the cosmetics remaining unselected may accidentally be ejected from the holder casing.

In view of the foregoing, U.S. Pat. No. 4,562,923 teaches a cosmetic holder casing arrangement including the means to overcome such problems and excelling in the easy-to-carry and use-properties.

According to the teachings disclosed therein, a push buttone are used as the releasing means to eject stick-like cosmetics, etc. contained in the casing body therefrom, and a spring used for urging holding members for retaining stick-like cosmetics is designed to exert a spring force higher than that capable of ejecting a plurality of stick-like cosmetics at a time. Accordingly, where only two sticks are contained in a casing body which can contain, for instance, six sticks, the spring force exerted is so strong that the cosmetic sticks receive strong impacts, when ejected, with the resulting fear of damage. Occasionally, the cosmetic sticks may disengage the associated holding member, leading to complete ejection thereof.

Especially when there are contained in the casing body a glass-made and miniaturized container having therein manicure, lotion, eau de cologne, perfume, hair tonic and the like or a cosmetic product heavier than the cosmetic sticks such as, for example, mascara, eyeliners and the like. It is required to increase the spring pressure due to the large weight thereof. When cosmetic sticks are contained in such a holder casing, additional problems often arise.

SUMMARY OF THE INVENTION

An object of the present invention is to provide a novel cosmetic holder casing for stick-like cosmetics, which overcome the problems of the prior art.

According to the present invention, this object is achieved by the provision of a cosmetic holder casing for a plurality of stick-like cosmetics such as eye shadow, lipsticks and the like, comprising in combination:

a box-like body which is open at the upper end thereof, a moving holder which is inserted into said body in a vertically slidable manner, and is brought into resilient contact with the sides of said cosmetics to retain them in side-by-side relation, a moving cylinder body mounted on said plurality of moving holders, which projects toward the bottom portion of said box-like body, a rotating cylinder body inserted over said moving cylinder body for rotatably movement therearound and axially slidable movement, a resilient body disposed on the said box-like body for forcing said moving cylinder body upwardly relative to said rotating cylinder body, a locking mechanism interposed between said moving cylinder body and said rotating cylinder body for limiting upward movement of said moving cylinder body by said resilient member, a ratchet mechanism for effecting relative rotational movement of said moving cylinder body and said rotating cylinder body in one direction, when said moving cylinder body is forced down, and said locking mechanism comprising pawl portions provided on the said moving cylinder body and a toothed portion formed on the inner face of said rotating cylinder body, which has a continuous groove for engagement with said pawl portions, said toothed portion having adjacent grooves being varied in depth.

Another object of the present invention is to provide the cosmetic holder casing as mentioned above, wherein said box-like body comprises a pair of halves each in the form of a rectangular dish, which are combined to each other to define therein a space for the accommodation of said moving holder.

A further object of the present invention is to provide the cosmetic holder casing as mentioned above, wherein said moving holder and said moving cylinder body are formed of a suitable synthetic resin as one integral piece, and said moving holder comprises a plurality of cylindrical holding portions being disposed with the axes thereof being in parallel, said holding portions receiving therein said sticklike cosmetics.

A still further object of the present invention is to provide the cosmetic holder casing as mentioned above, wherein said moving cylinder is contiguous to the lower end of the middle holding portion and projects toward a bottom plate portion of said box-like body, and is provided on the outer face of the lower portion thereof with the pawl portions of said ratchet mechanism and said locking mechanism, which are varied in vertical positions.

BRIEF DESCRIPTION OF THE DRAWINGS

Other objects and features of the present invention will be apparent from the following detailed description of the preferred embodiments, by way of example, and the accompanying drawings, in which.

PREFERRED EMBODIMENTS OF THE INVENTION

Figure 1:
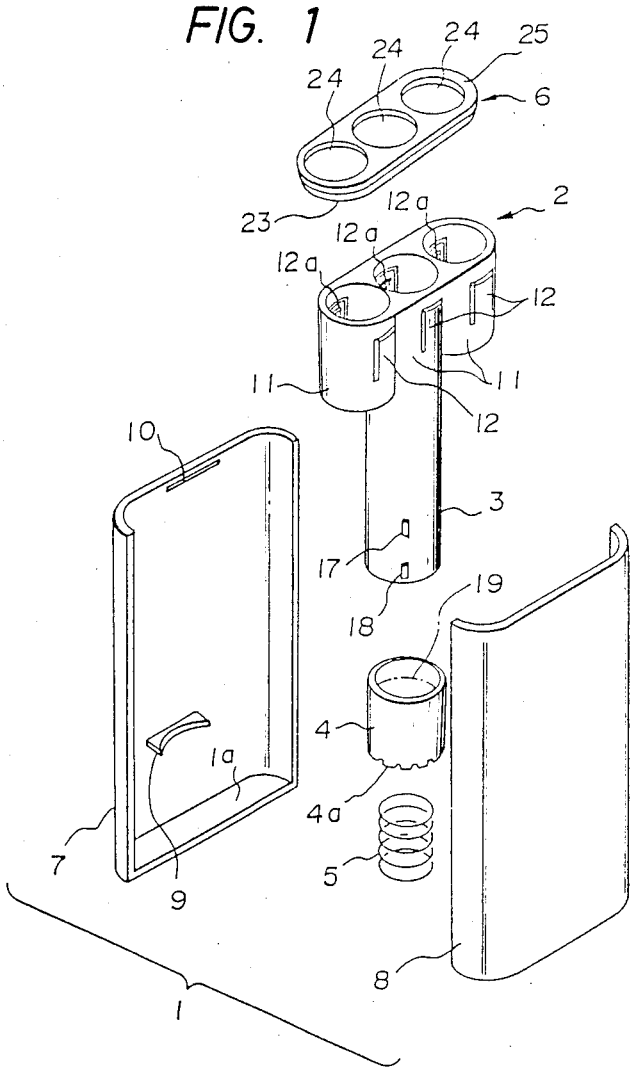
FIG. 1 is an exploded perspective view showing one embodiment of the present invention.
Figure 2:
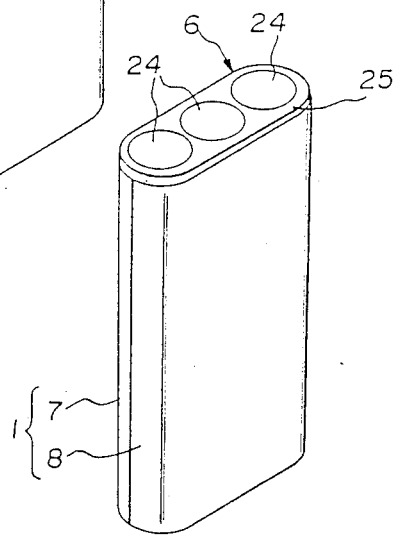
FIG. 2 is a perspective view of that embodiment in an assembled state.

One embodiment will now be explained with reference to FIGS. 1 to 5 inclusive. In the drawings, reference numeral 1 stands for a box-like body 1 for accommodating stick-like cosmetics P such as eye shadow pencils, lipsticks and the like, 2 a moving holder for holding a plurality of stick-like cosmetics P in side-by-side relation, 3 a moving cylinder body mounted into the moving holder 2 in the form that one of the cosmetics P received in the middle of the moving holder 2 is covered therewith from below, 4 a rotating cylinder body fitted over the moving cylinder body 3 in rotatable and axially slidable relation, 5 a coil spring disposed at the lower end of the moving cylinder body 3 for forcing up the same, and reference numeral 6 stands for an upper plate attached to the upper end of the case body 1. The members indicated by 1 to 6 forms part of the cosmetic holder casing according to the instant embodiment.

The body 1 includes a pair of halves 7 and 8, each being in the form of a rectangular dish, which are put together face-to-face to define therein a space for the accommodation of the moving holder 2. Each of the halves 7 and 8 is provided on its inside face with a protrusion 9 for retaining the rotatable cylinder body 3 in place. It is understood that each of the halves 7 and 8 is provided on the inner face of its upper end with a groove 10 by which the upper plate 6 is fixed in place.

On the other hand, the moving holder and cylinder body 2 and 3 are formed of a suitable synthetic resin as one integral pieces. The moving holder 2 basically includes three holding members 11 arranged with their axes being in parallel with one another, into which the stick-like cosmetics P are inserted for holding. It is understood that each holding member 11 has C-shaped notches formed in the opposite walls, which define together a resilient portion 12 which comes in resilient contact with the cosmetics P for supporting. In the instant embodiment, it is also understood that, while the resilient portion 12 is provided on the inner face with a locking protrusion 14 and a recession 12*a* to engage a peripheral protrusion 13 of the cosmetics P, it is not always required to provide such peripheral and locking protrusions 13 and 14 as mentioned above. However, it is noted that the provision of the peripheral and locking projections 13 and 14 presents a convenience that the stick-like cosmetics P can easily be located when they are inserted into the holding portions 11, since overriding of the peripheral protrusion 13 over the locking protrusion 14 is transmitted to the finger.

On the other hand, the moving cylinder body 3 is contiguous to the lower end of the middle holding portion 11, and projects toward a bottom plate 1a of the body 1. The moving cylinder body 1 is also formed as a whole in the bottomed form, and is provided on the outer periphery of the lower portion with pawl portions 17 and 18 of ratchet and locking mechanisms 15 and 16 to be described later, which are vertically spaced away from each other.

The rotating cylinder body 4 is provided around its inner face with a belt-like annular step 19, in the upper and lower portions of which there are continuously formed grooves 20 and 21 for engagement with the pawl portions 17 and 18 of the ratchet and locking mechanisms 15 and 16. It is noted that the rotating cylinder body 4 is corrugated at the lower end 4*a* so as to assure smooth sliding thereof during rotation.

While the instant embodiment has been described as using the coil spring 5 as the elastic body for forcing up the moving cylinder body 3, the present invention is not limited thereto. It is noted that use may be made of any member capable of biasing the moving cylinder body 3 upwardly, for instance, a leaf spring.

Referring supplementarily to the upper plate 6 for covering the upper end opening of the body 1, it is comprised of a side plate 23 having a projecting rib 22 to be fitted into the groove 10 formed in the upper end of the body 1 and a ceiling plate 25 having therein a hole 24 for the insertion of the stick-like cosmetics P, corresponding to the position of each holding portion 11.

Figure 3:
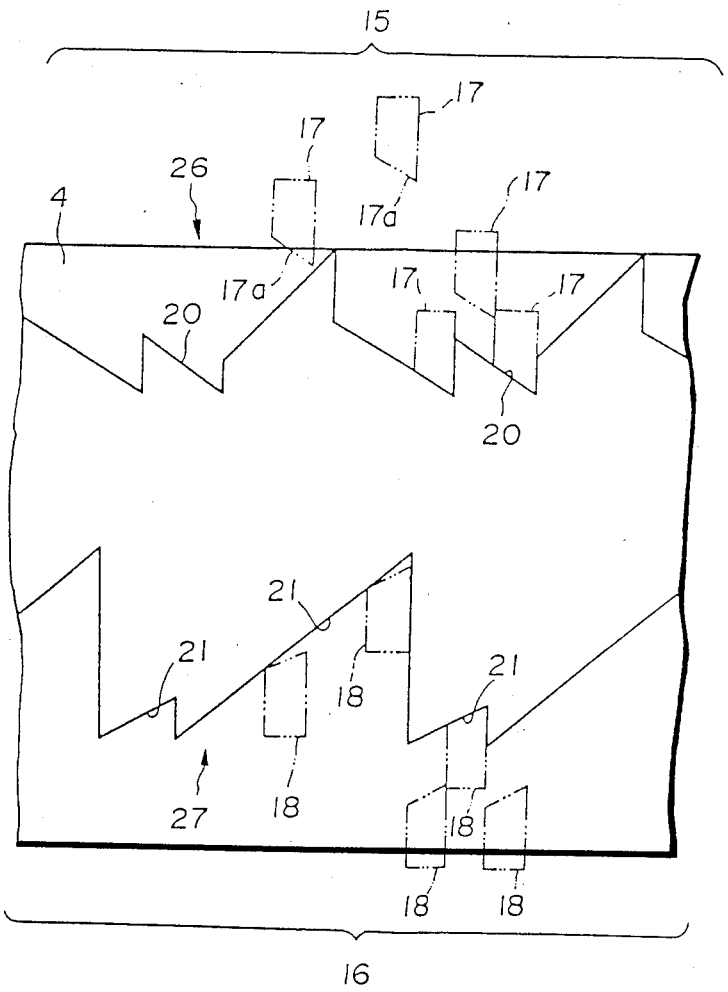
FIG. 3 is a front view illustrating the grooves in the locking and ratchet mechanisms.

Turning now to the ratchet and locking mechanisms 15 and 16 with reference to FIG. 3, the ratchet mechanism 15 designed in such a manner that, when the moving cylinder body 3 descends, the leading end 17*a* of the pawl portion 17 slides on an inclined plane of the groove 20 to intermittently rotate the moving cylinder body, until the pawl portion 17 engages within the groove 20. More specifically, the ratchet mechanism 15 is primarily comprised of the pawl portion 17 of the moving cylinder body 3 and a toothed portion 26 comprising a successive groove 20 formed in the upper end of the annular step 19. In the instant embodiment, the leading end 17*a* of the pawl portion 17 is tapered off in such a manner that the left side thereof is inclined downwardly, while the groove 20 is formed in the direction of inclination of the leading end 17*a* of the pawl portion 17.

The locking mechanism 16 is primarily comprised of a pawl portion 17 projecting from the lower and outer periphery of the moving cylinder body 3 and a toothed portion 27 comprising a groove 21 formed contiguous to the lower end of the annular step 19. It is noted that the leading end 18*a* of the pawl portion 18 is in opposition to the leading end 17*a* of the pawl portion 17 of the ratchet mechanism 15. Adjacent grooves 21 of the toothed portion 27 are of a depth that is varied at two stages, so that the position of engagement with the pawl portion 18 is varied depending upon the depth of the grooves 21 to vary the elevations of the moving cylinder body 3 and the moving holder 2, whereby the stick-like cosmetics P are inserted into or removed from the body 1.

The cosmetic holder casing as arranged in the foregoing operates as follows.

Figures 4, 5, 6:
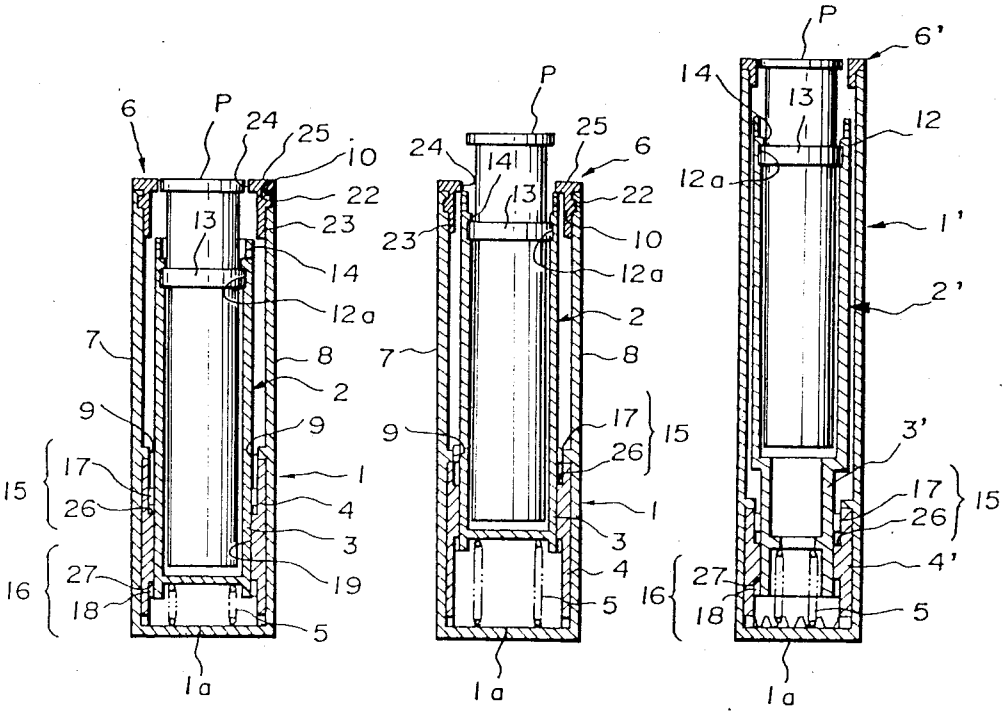
FIGS. 4 and 5 are views, centrally and longitudinally sectioned, illustrating the action of the first embodiment of the presnt invention.
FIG. 6 is a view, centrally and longitudinally sectioned, of another embodiment of the present invention.

As illustrated in FIG. 4, when a push is given to the upper end of the stick-like cosmetics P in a state where the holding portions 11 having the stick-like cosmetics P inserted therein are put order in the body 1, the pawl portion 17 of the locking mechanism 15 disengages the groove 20 therein. On the other hand, the pawl portion 18 of the ratchet mechanism 18 slides over the inclined plane of the groove 21 to turn the rotating cylinder body 4 counterclockwise, thereby shifting the position of engagement of the pawl portion 17 within the groove 20 one by one. This operation allows the moving holder 2 integral with the moving cylinder body 3 to be forced up under the action of the coil spring 5 by an amount corresponding to an increase in the depth of the groove 20, so that, as illustrated in FIG. 5, the stick-like cosmetics P project from the upper end opening for removal.

On the other hand, when the stick-like cosmetics P are again put order in the case, they are inserted through the insertion openings 24 formed in the upper plate 6 into the holding portions 11 of the moving holder 2. Then, a push is given thereto, as is the case with the removal of the upper ends of the cosmetics P to vary the position of the groove 21 forming the locking mechanism 16 for accommodation. In a state where the stick-like cosmetics are put order, they engage the resilient plate portion 12 through the associated recessions 12*a* so that they are securely retained in place with no fear of accidental spring-over of the stick-like cosmetics P during carrying.

Further, since the stick-hole cosmetics P come into resilient contact with the resilient plate portions 12 of the holding portion 11, where stored in the moving holder 2. Thus, they are protected against any external impact, so that they are prevented from suffering damage.

FIG. 6 shows another embodiment of the present invention, according to which the cosmetic casing is decreased in length as a whole for further thinning. This is achieved by fitting a moving cylinder body 3' having a diameter smaller than that of each holding portion 11' of a moving holder 2' into a rotating cylinder body 4'.

According to the embodiments of the present invention as explained in the foregoing, the following effects can be obtained.

1. It is easy to remove the stick-like cosmetics put order from the holder casing according to the present invention, since they can be ejected therefrom in the so-called one-touch operation. 2. The holder casing according to the present invention can be applicable to commercially available lipsticks, eye shadow products and the like.

Obviously, many modifications and variations of the present invention are possible in the light of above teachings. It is therefore to be understood that within the scope of the appended claims, the invention may be practiced otherwise than as specifically described.

What is claimed is:

1. A cosmetic holder casing for a plurality of stick-like cosmetics such as eye shadow, lipsticks and the like, comprising in combination:

a box-like body which is open at the upper end thereof, a moving holder which is inserted into said body in a vertically slidable manner, and is brought into resilient contact with the sides of said cosmetics to retain them in side-by-side relation, a moving cylinder body mounted on said plurality of moving holders, which projects toward the bottom portion of said box-like body, a rotating cylinder body inserted over said moving cylinder body for rotatably movement therearound and axially slidable movement, a resilient body disposed on the said box-like body for forcing said moving cylinder body upwardly relative to said rotating cylinder body, a locking mechanism interposed between said moving cylinder body and said rotating cylinder body for limiting upward movement of said moving cylinder body by said resilient member, a ratchet mechanism for effecting relative rotational movement of said moving cylinder body and said rotating cylinder body in one direction, when said moving cylinder body is forced down, and said locking mechanism comprising pawl portions provided on the said moving cylinder body and a toothed portion formed on the inner face of said rotating cylinder body, which has a continuous groove for engagement with said pawl portions, said toothed portion having ajajcent grooves being varied in depth.

2. A cosmetic holder casing as defined in claim 1, wherein said box-like body comprises a pair of halves each in the form of a rectangular dish, which are combined to each other to define therein a space for the accommodation of said moving holders.

3. A cosmetic holder casing as defined in claim 1, wherein said moving holder and said moving cylinder body are formed of a suitable synthetic resin as one integral piece, and said moving holder comprises a plurality of cylindrical holding portions being disposed with the axes thereof being in parallel, said holding portions receiving therein said stick-like cosmetics.

4. A cosmetic holder casing as defined in claim 1, wherein said moving cylinder is continuous to the lower end of the middle holding portion and projects toward a bottom plate portion of said box-like body, and is provided on the outer face of the lower portion thereof with the pawl portions of said ratchet mechanism and said locking mechanism, which are varied in vertical positions.

* * * * *